US012797944B2

(12) United States Patent
Johnston

(10) Patent No.: US 12,797,944 B2
(45) Date of Patent: Nov. 17, 2026

(54) METHOD OF MANUFACTURING A BAR PIN

(71) Applicant: The Pullman Company LLC, Northville, MI (US)

(72) Inventor: Brent D. Johnston, Milan, OH (US)

(73) Assignee: The Pullman Company LLC, Northville, MI (US)

( * ) Notice: Subject to any disclaimer, the term of this patent is extended or adjusted under 35 U.S.C. 154(b) by 279 days.

(21) Appl. No.: 18/606,349

(22) Filed: Mar. 15, 2024

(65) Prior Publication Data

US 2025/0289052 A1 Sep. 18, 2025

(51) Int. Cl.
*B21K 1/76* (2006.01)

(52) U.S. Cl.
CPC ..... *B21K 1/76* (2013.01)

(58) Field of Classification Search
CPC . B21K 1/74; B21K 1/76; B21K 1/761; B21K 1/766; B21K 1/762; B21D 41/045
USPC ..... 72/370.12
See application file for complete search history.

(56) References Cited

U.S. PATENT DOCUMENTS 308,348 A * 11/1884 Eckert ..... B21C 37/08 228/144
1,713,964 A * 5/1929 Hoff ..... B21F 1/06 72/399
1,719,243 A * 7/1929 Shaff ..... B21K 1/76 59/2
2,421,629 A * 6/1947 Langos ..... B65B 7/14 72/356
2,432,307 A * 12/1947 Good, Jr. ..... F16D 3/46 29/442
2,971,554 A * 2/1961 Knox ..... B21D 41/04 72/356
3,238,755 A * 3/1966 Macchini ..... B21K 1/74 72/308
3,553,826 A * 1/1971 Abe ..... B21K 1/44 29/898.052

(Continued)

FOREIGN PATENT DOCUMENTS

KR 100941722 B1 2/2010

OTHER PUBLICATIONS

JP 07-100576A, Yokoo et al. Apr. 1995.*
Translation JP 07-100526A, Yokoo et al. Apr. 1995.*
DE 102018129231A1, List et al. May 2020.*

*Primary Examiner* — Edward T Tolan
(74) *Attorney, Agent, or Firm* — Harness, Dickey & Pierce, P.L.C.

(57) ABSTRACT

A method of manufacturing a bar pin comprises positioning a slug of metal in a die and advancing a tool within the die to deform the slug and form a central portion of the bar pin. The slug is deformed to define first and second legs on a first side of the central portion and deforming the slug to define third and fourth spaced apart legs on a second side opposite the first side. The method further includes defining a finalized finished first surface having a semi-cylindrical shape and interconnecting the first and second legs. A finalized finished second surface having a semi-cylindrical shape is defined and interconnects the third and fourth legs. Subsequent to the defining steps, the first and second legs are radially inwardly deformed to define a first closed aperture. Optionally, the third and fourth legs are radially inwardly deformed to define a second closed aperture.

20 Claims, 4 Drawing Sheets

(56) References Cited

U.S. PATENT DOCUMENTS

| | | | | |
|---|---|---|---|---|
| 3,644,973 | A * | 2/1972 | Abe | B21C 23/03 29/898.052 |
| 3,740,986 | A * | 6/1973 | Schmid | B21H 7/00 72/107 |
| 4,732,030 | A * | 3/1988 | Tanaka | B21D 53/88 72/356 |
| 7,165,909 | B2 | 1/2007 | Buhl et al. | |
| 8,192,106 | B2 | 6/2012 | Vogler et al. | |
| 8,226,100 | B2 * | 7/2012 | Rodecker | F16F 1/3863 267/141.2 |
| 8,234,763 | B2 * | 8/2012 | Murakami | B62K 21/04 29/90.01 |
| 10,767,721 | B2 | 9/2020 | Zimmerman et al. | |
| 11,685,209 | B2 | 6/2023 | Jo | |
| 11,833,879 | B1 | 12/2023 | Johnston | |
| 2018/0361811 | A1 | 12/2018 | Chua et al. | |

* cited by examiner

METHOD OF MANUFACTURING A BAR PIN

FIELD

The present disclosure relates to a method of manufacturing a bar pin for a bushing assembly that may be used in a vehicle suspension. More particularly, the method includes cold heading, forging or otherwise forming a pin having slotted ends. As the pin forming process continues, the slotted ends are deformed to define closed apertures.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Bushings are often used to interconnect vehicular suspensions system components in such a manner that desired loads are transferred between the components, but noise, vibration, and harshness are not. Elastomeric bushing assemblies have been installed in various components of a vehicle, including but limited to torsion bars, torque rods, leaf springs, independent suspension control arms, and other suspension components.

Existing bushing assemblies typically consist of an outer metal component, an inner metal component and an elastomeric bushing disposed between the inner metal component and outer metal component. A solid bar pin may be inserted within the inner metal component or in some instances a solid bar pin replaces the inner metal component. In at least one example, the bar pin includes a cylindrical center section and flattened end sections at opposite ends of the bar pin.

A known manufacturing process for forming the bar pin includes forging or otherwise forming flats on the end of a solid cylindrical work piece. In a separate machine and during a separate later process, holes are drilled, punched or otherwise formed to extend through the flattened end portions of the bar pin. Significant cost and time are required to manufacture such a bar pin. As such, it may be desirable to provide an improved and streamlined bar pin manufacturing process.

SUMMARY

A method of manufacturing a bar pin comprises positioning a slug of metal in a die and advancing a tool within the die to deform the slug and form a central portion of the bar pin. The method includes deforming the slug to define first and second legs on a first side of the central portion and deforming the slug to define third and fourth spaced apart legs on a second side opposite the first side of the central portion. The method further includes defining a finalized finished first surface having a semi-cylindrical shape and interconnecting the first and second legs. A finalized finished second surface having a semi-cylindrical shape is defined and interconnects the third and fourth legs. Subsequent to the defining steps, the first and second legs are radially inwardly deformed to define a first closed aperture. Optionally, the third and fourth legs are radially inwardly deformed to define a second closed aperture.

In another embodiment, a method of manufacturing a bar pin includes positioning a slug of metal in a die. The slug is deformed to define a first slot between first and second spaced apart legs on a first side of the slug. The slug is also deformed to define a second slot between third and fourth spaced apart legs on a second side of the slug opposite the first side. A portion of a first side wall of the first slot is defined to include a first semi-cylindrical portion interconnecting the first and second legs. The first semi-cylindrical portion is a finalized finished surface upon which no further machine contact will be made. A portion of a second side wall of the second slot is defined to include a second semi-cylindrical surface interconnecting the third and fourth legs. The second semi-cylindrical portion is a finalized finished surface upon which no further machine contact will be made. Subsequent to the defining steps, the first and second legs are radially inwardly deformed to define a first closed aperture at least partially bounded by the first semi-cylindrical portion. Subsequent to the defining steps, the third and fourth legs are radially inwardly deformed to define a second closed aperture that is at least partially bounded by the second semi-cylindrical portion.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
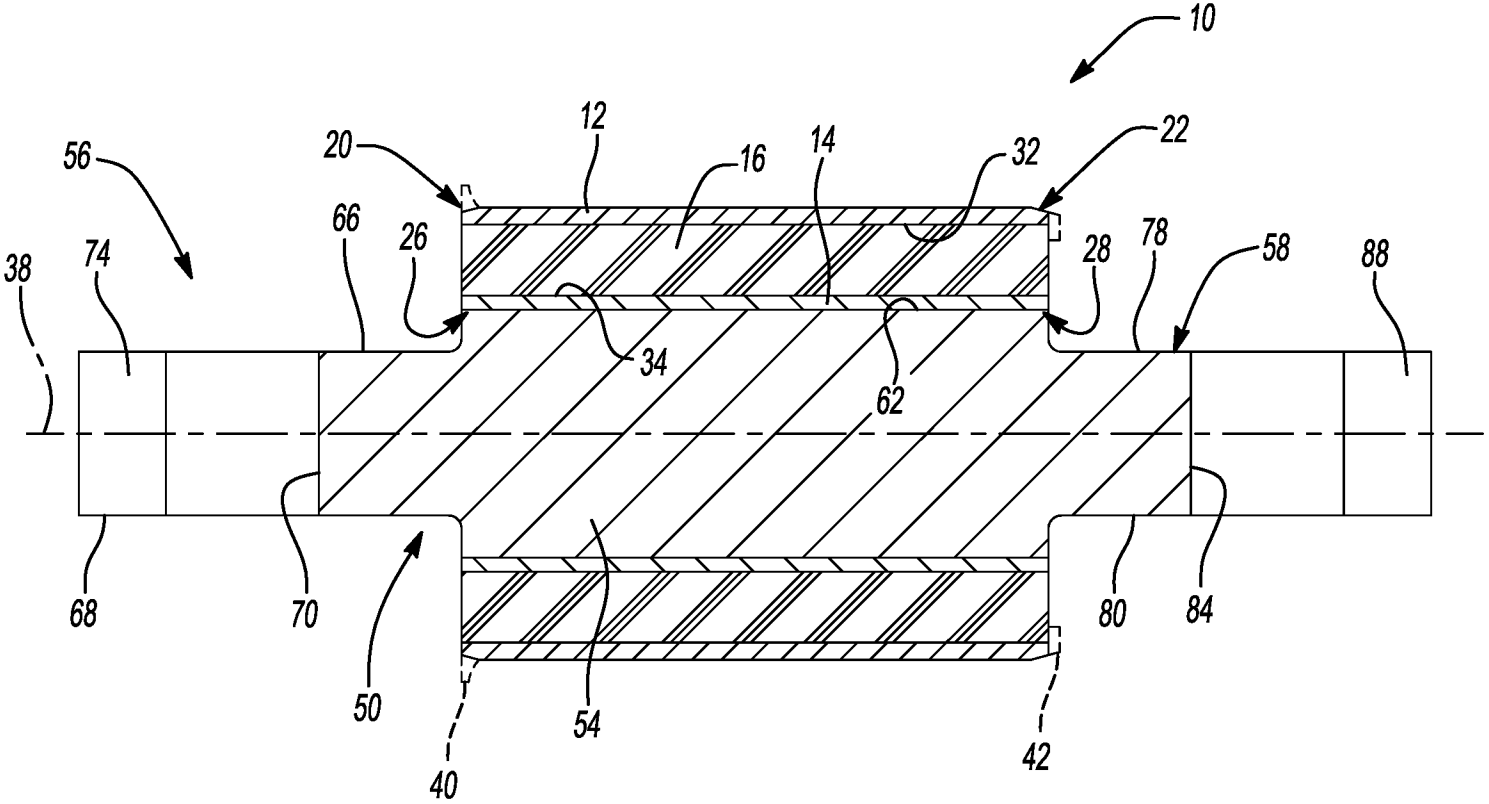
FIG. 1 is a cross-sectional view of a bushing assembly constructed in accordance with the teachings of the present disclosure.

Example embodiments will now be described more fully with reference to the accompanying drawings.

Example embodiments are provided so that this disclosure will be thorough, and fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a bushing assembly 10 is illustrated in accordance with the present disclosure. Bushing assembly 10 includes an outer sleeve 12, an inner sleeve 14, and an elastomeric body 16. Outer sleeve 12 is substantially cylindrically shaped as a thin wall hollow structure having a first end 20 and an opposite second end 22. Inner sleeve 14 includes a first end 26 and an opposite second end 28. Inner sleeve 14 is a substantially thin wall hollow cylindrical member longitudinally extending from first end 26 to second end 28.

Elastomeric body 16 is disposed radially between inner sleeve 14 and outer sleeve 12. Elastomeric body may be bonded to one or both of an inner cylindrical surface 32 of outer sleeve 12 and an outer cylindrical surface 34 of inner sleeve 14. Inner sleeve 14 and outer sleeve 12 coaxially extend with one another and are commonly aligned with a longitudinal axis 38 of bushing assembly 10. Inner sleeve 14 may exhibit a variety of different shapes and configurations other than depicted in the figures and may be made from a variety of different materials, all of which are within the scope of the present disclosure. By way of example and without limitation, inner sleeve 14 may have a right-circular cylindrical shape and may be made of metal.

Outer sleeve 12 may optionally include a radially outwardly extending flange 40 at first end 20. Alternatively, or in addition, outer sleeve 12 may include an optional radially inwardly extending flange 42 positioned at second end 22. It should be appreciated that outer sleeve 12 may exhibit different shapes and/or configurations than those shown in the figures and may be made from a variety of different materials, all of which are within the scope of the present disclosure. By way of example and without limitation, outer sleeve 12 may have a right-circular cylindrical shape and may be made of metal.

Elastomeric body 16 is depicted as a hollow cylindrically shaped member extending contiguously from first end 20 to second end 22 of outer sleeve 12. It should be appreciated, however, that elastomeric body 16 may exhibit a variety of different shapes and configurations and may be made from a variety of different materials, all of which are considered within the scope of the present disclosure. Elastomeric body 16 functions to mechanically decouple inner sleeve 14 from outer sleeve 12. As such, elastomeric body 16 is preferably constructed from a material that is resilient and capable of deflecting and damping vibrations. For example, elastomeric body 16 may be made of natural rubber.

In accordance with the present disclosure, bushing assembly 10 includes a bar pin 50 that may be positioned within inner sleeve 14 in a slip-fit manner or alternatively press fit to the inner diameter of inner sleeve 14. In another alternate configuration not shown, inner sleeve 14 may be eliminated entirely and replaced with bar pin 50.

Bar pin 50 includes a central portion 54, a flattened first end 56, and a flattened second 58. First end 56 is positioned at an opposite longitudinal extent of bar pin 50 as flattened second end 58. Central portion 54 may be solid and cylindrical shaped. Central portion 54 includes an outer surface 62 that is cylindrically shaped having an outer diameter slightly greater than an inner diameter of an inner sleeve 14, if a press fit is to be provided. Central portion 54 may exhibit a variety of other cross-sectional shapes without departing from the scope of the present disclosure. At least polygonal and irregular cross-sectional shapes are contemplated. A hollow or recessed configuration is also possible.

Flattened first end 56 includes a first surface 66 and an opposite second surface 68 both of which are substantially planar. First surface 66 extends substantially parallel to second surface 68 at a predetermined distance. A first closed aperture 70 extends through flattened first end 56. First end 56 also includes a first face 74 opposing a second face 76. First face 74 may directly engage second face 76 or be spaced apart therefrom.

Flattened second end 58 includes a third surface 78 and an opposite fourth surface 80. Third surface 78 and fourth surface 80 are substantially planar surfaces that extend parallel to one another at a predetermined distance preferably, but not necessarily, equal to the predetermined distance between first surface 66 and second surface 68. An aperture 84 extends through second end 58. Second end 58 includes a third face 88 and an opposite fourth face 90. Third face 88 extends parallel to fourth face 90. Third face 88 and fourth face 90 may directly engage one another or be spaced apart.

Figure 2:
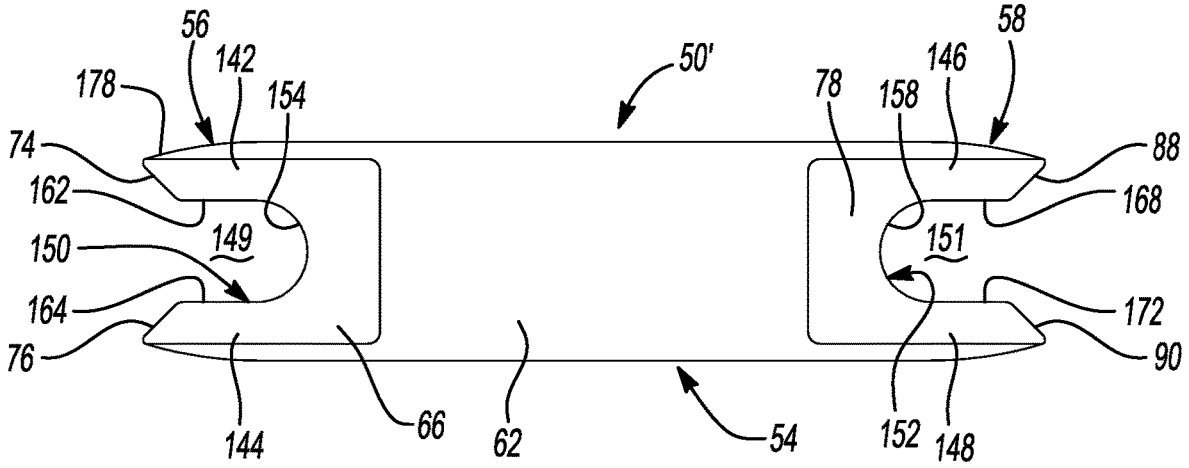
FIG. 2 is a top view of a work-in-process bar pin constructed in accordance with a method of the present disclosure.
Figure 4:
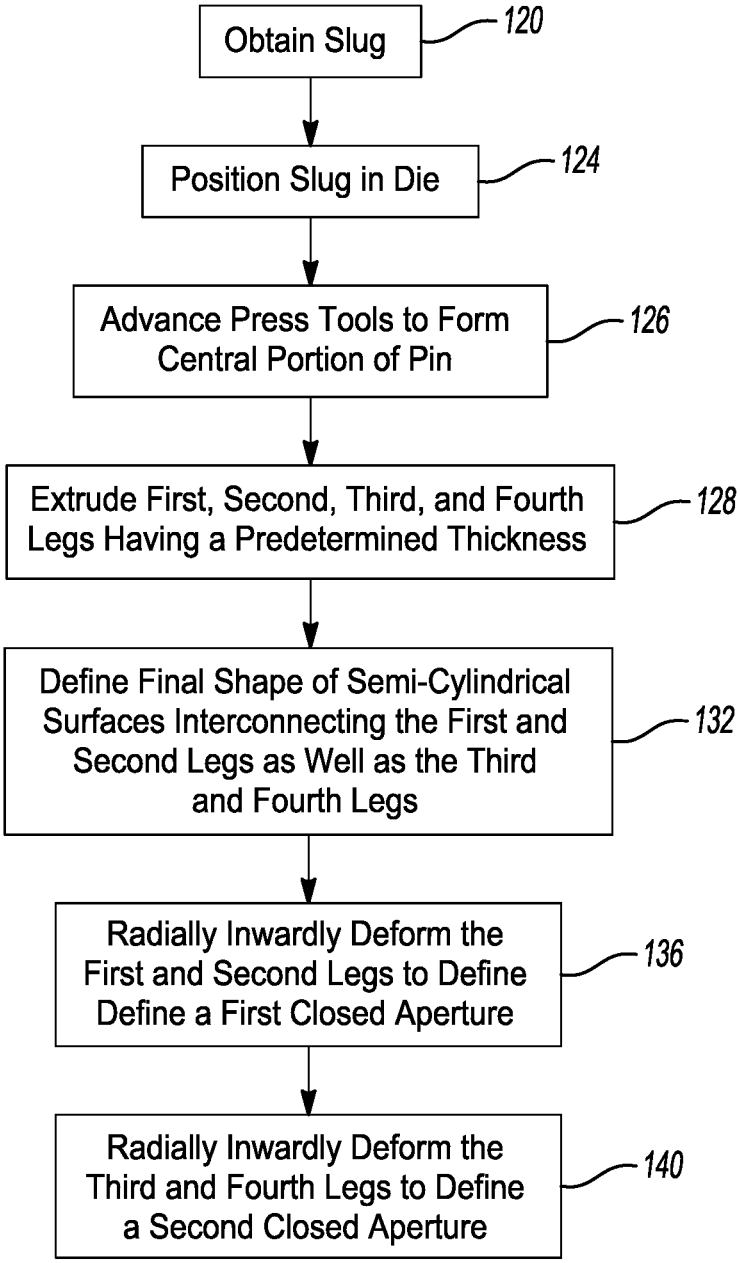
FIG. 4 is a flow chart describing a method of manufacturing the bar pin.

FIG. 2 depicts a work-in-process version of the bar pin identified as 50'. FIG. 4 provides a flow chart of an exemplary process to manufacture bar pin 50. It is envisioned that bar pin 50 is constructed using a cold heading process, a forging process, or the like. At step 120, a slug of metal is obtained. The slug may comprise a relatively low carbon steel alloy such as SAE 1018 or SAE 1020. Alternatively, a higher carbon steel alloy such as SAE 1035 or SAE 1045 may be implemented and bar pin 50 may be through hardened.

At step 124, the slug is positioned in a die of a cold heading machine or a forging apparatus, or the like. It is contemplated that the die likely includes multiple cavities arranged as a progressive die. As such, the various cavities of the die are shaped differently than the other, and the last die cavity most closely resembles the finished product. A first cavity is shaped differently than the shape of the slug initially positioned within the first cavity. In the cold heading process, heat is not added to the slug or the tool. At step 126, at least one portion of a tool is advanced toward the slug to change the three-dimensional shape of the slug to form at least a central portion 54 of bar pin 50. It should be appreciated that outer surface 62 of central portion 54 is not necessarily deformed into its final shape within this particular die cavity of the tool. A second or third cavity of the progressive die may define outer surface 62 at its final dimension.

At step 128, first end 56 is flattened to define first surface 66 and parallel second surface 68. Second end 58 is mechanically deformed to define third surface 78 and opposite and parallel fourth surface 80. The flattening steps preferably occur simultaneously, but not necessarily so. Either concurrently or subsequently, first end 56 is divided into a first leg 142 and a second leg 144. First leg 142 and second leg 144 extend substantially parallel to longitudinal axis 38 and parallel to one another. In similar fashion, a third leg 146 and a fourth leg 148 are defined at second end 58. Third leg 146 and fourth leg 148 extend parallel to and spaced apart from one another and provide a mirror image of first leg 142 and second leg 144.

During or after the first and second legs 142, 144 are formed, a first slot 149 including a first sidewall 150 is defined. First sidewall 150 includes a first semicylindrical portion 154 defined at step 132 of the manufacturing process. The semicylindrical shape may be defined in the same die cavity as first through fourth legs 142, 144, 146, 148 or a subsequent die cavity may be utilized. Importantly, first semicylindrical portion 154 is a finalized finished surface that will not be engaged by another portion of the tool or machined later at a different workstation. Second semicylindrical portion 158 is also defined within the die cavity as a final finished surface that will not be manipulated machined, ground or otherwise modified after step 132 has been completed.

First sidewall 150 further includes a first portion 162 formed on first leg 142 and an opposed second portion 164 formed on second leg 144. At this stage of manufacture, the first and second portions 162,164 are substantially planar surfaces uninterruptedly joined to first semicylindrical portion 154. First semicylindrical portion 154 interconnects first leg 142 with second leg 144. First portion 162 and second portion 164 are also finalized surfaces that will not be machined at a later step. These surfaces, however, will be changed from planar surfaces to curved surfaces as will be described later.

Second end 58 includes a second slot 151 including a second sidewall 152. Second sidewall 152 includes a second semicylindrical portion 158, a third portion 168 formed on third leg 146, and a fourth portion 172 formed on fourth leg 148. Third portion 168 extends substantially parallel to fourth portion 172. Second semicylindrical portion 158 intersects the ends of the third portion 168 and fourth portion 172 to define second slot 151. Machining, coining or otherwise modifying second sidewall 152 will not occur other than modifying the shape of third leg 146 and fourth leg 148 at step 140. As the final mechanical deformation steps of the manufacturing process, steps 136 and 140 may be sequentially or simultaneously performed. The cold heading machine may be equipped with diametrically opposed heads that are moveable toward and away from one another. Through the use of this type of cold heading machine, step 128 may include simultaneously defining first, second, third and fourth legs 142, 144, 146, 148. Step 132 may be simultaneously performed with step 128.

Figure 3:
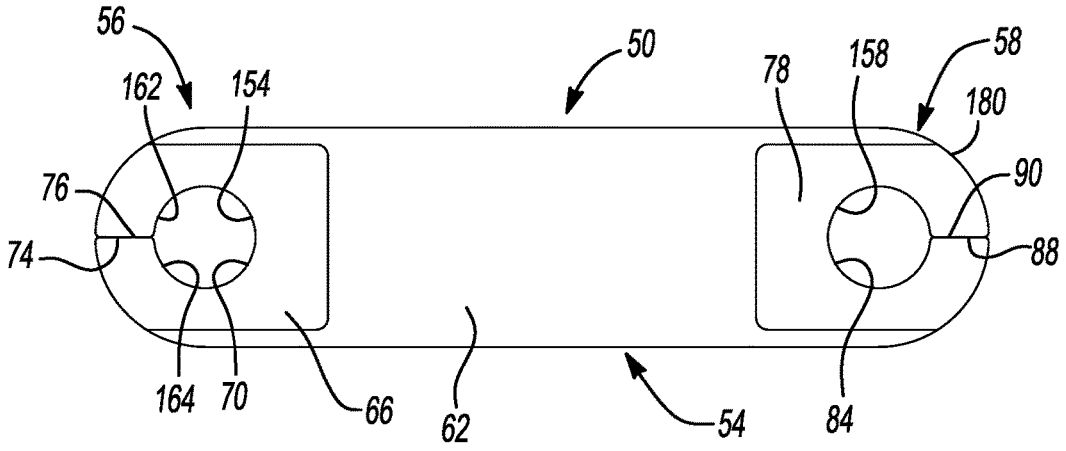
FIG. 3 is a top view of a completed bar pin.

At step 136, a tool engages an outer surface 178 of first end 56 to radially inwardly deform first leg 142 and second leg 144 toward one another to define closed aperture 70 in an approximate right circular cylindrical shape as depicted in FIG. 3. First semicylindrical portion 154 will remain as an accurately defined semicylindrical surface. First portion 162 and second portion 164 are curved based on the mechanical deformation of the first and second legs 142, 144 via engagement of a tool to outer surface 178. Step 136 may continue until first face 74 directly engages second face 76. Alternatively, step 136 may cease after first leg 142 and second leg 144 are sufficiently radially inwardly deformed to define first closed aperture 70 without causing first face 74 and second face 76 to contact one another. Either solution is acceptable.

A guide pin or other support is not positioned within first slot 149 nor second slot 151 during execution of steps 136 or 140. Accordingly, the shape of first portion 162 and second portion 164 merely approximate a semicylindrical surface. During steps 136 and 140, care is taken to assure that a go/no-go gauge pin will pass through first closed aperture 70 after completion of step 136. In this manner, a fastener (not shown) useful for coupling bushing assembly 10 to a vehicle will pass through first closed aperture 70.

Step 140 is substantially the same as step 136 except it is performed on second end 58. An outer surface 180 of second end 58 is engaged by a tool at step 140 to radially inwardly deform third leg 146 and fourth leg 148 toward one another. This step of the process closes U-shaped second slot 151 to define second closed aperture 84. Step 140 may include directly engaging third face 88 with fourth face 90. Alternatively, third face 88 may remain spaced apart from fourth face 90 after successful completion of step 140. A "closed aperture", as discussed in relation to first closed aperture 70 and second closed aperture 84, exists even if first face 74 does not directly contact and engage second face 76 or when third face 88 remains spaced apart from fourth face 90. The opposing dual head arrangement of the cold heading machine also allows simultaneously performing steps 136 and 140.

To further describe Applicant's intention regarding the meaning of a "closed aperture," it is envisioned that a gap may exist between first face 74 and second face 76 to the extent that an uninterrupted surface defining first closed aperture 70 extends greater than or equal to 350 degrees. This interpretation also applies to second closed aperture 84 and second sidewall 152 (third portion 168, second semicylindrical portion 158 and fourth portion 172) contiguously extending greater than or equal to 350 degrees in a circular cylindrical shape.

Figure 5:
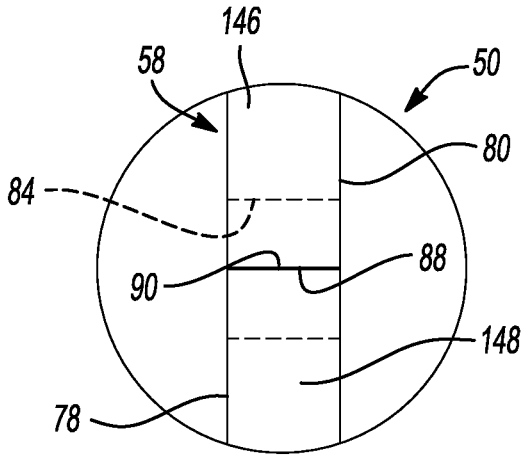
FIG. 5 is an enlarged side view of the bar pin.

FIG. 5 provides an enlarged side view of bar pin 50. Second end 58 is shown in detail in this view. Third leg 146 and fourth leg 148 are formed to each include a portion of third surface 78 that lies on a common plane. Similarly, each of third leg 146 and fourth leg 148 include portions of fourth surface 80 that remain on a common plane after the final forming step is completed by radially inwardly deforming third leg 146 and fourth leg 148 to define closed aperture 84 as a substantially cylindrically shaped bore.

Figure 6:
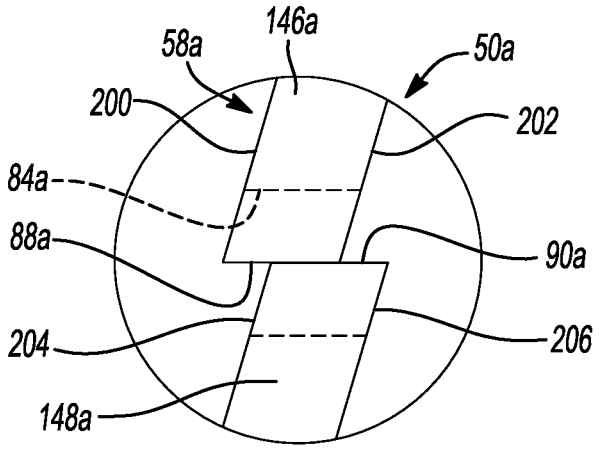
FIG. 6 is an enlarged side view of an alternate bar pin.

FIG. 6 depicts an alternate embodiment bar pin at reference numeral 250. Bar pin 250 is substantially similar to bar pin 50. As such, similar elements will be identified with like reference numerals including a lower "a" suffix. Only the differences between the embodiments will be discussed in detail. The embodiment of FIG. 6 incorporates a lock washer concept at second end 58*a* by offsetting third leg 146*a* relative to fourth leg 148*a* such that third leg 146*a* includes a fifth surface 200 and an opposite sixth surface 202 that extend substantially parallel to one another. Fourth leg 148 includes a seventh surface 204 and an opposite eighth surface 206 that extend substantially parallel to one another. It should be appreciated, however, that fifth surface 200 of third leg 146*a* is not coplanar with seventh surface 204 of fourth leg 148*a*. Fifth surface 200 may or may not extend parallel to seventh surface 204. Similarly, sixth surface 202 of third leg 146*a* does not lie in the same plane as eighth surface 206 of fourth leg 148*a*. Sixth surface 202 may or may not extend parallel to eighth surface 206. Third face 88*a* and fourth face 90*a* may be positioned in direct contact with one another or may be spaced apart from one another. It is envisioned that these faces 88*a*,90*a* extend parallel with one another. Closed aperture 84*a* extends through second end 58*a*.

When bar pin 50*a* is coupled to another component via a fastener (not shown), a clamping load exerted by the fastener will deflect third leg 146*a* and fourth leg 148*a* toward one another to move fifth surface 200 and seventh surface 204 toward one another and closer to alignment on a common plane with one another. Based on the material properties of the bar pin, a spring load will be applied to the fastener to provide an anti-rotation feature or "lock washer" function.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure. For example, bar pin 50 is depicted as having both first end 56 and second end 58 configured to have closed apertures. It is within the scope of the present disclosure that only one end includes either closed aperture 70 or closed aperture 84 while the opposite end remains shaped as a slot such as slots 149, 151.

What is claimed is:

1. A method of manufacturing a bar pin for an elastomeric bushing, the method comprising:

positioning a slug of metal in a die;

advancing a tool within the die to deform the slug and form a central portion of the bar pin;

deforming the slug to define first and second spaced apart legs on a first side of the central portion;

deforming the slug to define third and fourth spaced apart legs on a second side opposite the first side of the central portion;

defining a finalized finished first surface having a semi-cylindrical shape and interconnecting the first and second legs;

defining a finalized finished second surface having a semi-cylindrical shape and interconnecting the third and fourth legs; and subsequent to the defining steps, radially inwardly deforming the first and second legs to define a first closed aperture without contacting the semi-cylindrical shape of the finalized finished first surface.

2. The method of claim 1, wherein the step of deforming the slug to define first and second spaced apart legs includes defining a first slot having a first sidewall, the first semi-cylindrical surface being a portion of the first sidewall.

3. The method of claim 2, wherein the step of deforming the slug to define third and fourth spaced apart legs includes defining a second slot having a second sidewall, the second semi-cylindrical surface being a portion of the second sidewall.

4. The method of claim 3, wherein the radially inwardly deforming step is performed while the first sidewall and the second sidewall are not contacted with a tool.

5. The method of claim 1, wherein the first closed aperture is not geometrically modified after completion of the last method step.

6. The method of claim 1, wherein the first leg includes a first end face and the second leg includes a second end face, wherein the first end face and the second end face are positioned proximate one another after completing the step of radially inwardly deforming the first and second legs to define a first closed aperture.

7. The method of claim 1, further comprising subsequent to the defining steps, radially inwardly deforming the third and fourth legs to define a second closed aperture.

8. The method of claim 1, wherein the first leg, the second leg, the third leg and the fourth leg are of equal length.

9. The method of claim 1, wherein the central portion extends along a longitudinal axis, wherein the first leg, the second leg, the third leg and the fourth leg extend parallel to the longitudinal axis.

10. The method of claim 1, wherein all steps of the method are completed without addition of heat.

11. The method of claim 1, wherein the first leg and the second leg lie on different planes after completing the radially inwardly deforming steps.

12. The method of claim 1, wherein the bar pin is symmetrical about a plane passing through a longitudinal axis of the bar pin and an axis transverse to the longitudinal axis.

13. A method of manufacturing a bar pin for an elastomeric bushing, the method comprising:

positioning a slug of metal in a die;

deforming the slug define a first slot between first and second spaced apart legs on a first side of the slug;

deforming the slug to define a second slot between third and fourth spaced apart legs on a second side of the slug opposite the first side;

defining a portion of a first sidewall of the first slot to include a first semi-cylindrical portion interconnecting the first and second legs, the first semi-cylindrical portion being a finalized finished surface upon which no further machine contact will be made;

defining a portion of a second sidewall of the second slot to include a second semi-cylindrical portion interconnecting the third and fourth legs, the second semi-cylindrical portion being a finalized finished surface upon which no further machine contact will be made;

subsequent to the defining steps, radially inwardly deforming the first and second legs to define a first closed aperture without contacting the first semi-cylindrical portion, wherein the first closed aperture is at least partially bounded by the first semi-cylindrical portion; and subsequent to the defining steps, radially inwardly deforming the third and fourth legs to define a second closed aperture without contacting the second semi-cylindrical portion, wherein the second closed aperture is at least partially bounded by the second semi-cylindrical portion.

14. The method of claim 13, wherein the radially inwardly deforming steps are performed while the first sidewall and the second sidewall are not contacted with a tool.

15. The method of claim 13, wherein the first closed aperture and the second closed aperture are not geometrically modified after completion of the last method step.

16. The method of claim 13, wherein the first leg includes a first end face and the second leg includes a second end face, wherein the first end face and the second end face are positioned proximate one another after completing the step of radially inwardly deforming the first and second legs to define a first closed aperture.

17. The method of claim 13, further including deforming the slug to define a central portion shaped as a cylinder.

18. The method of claim 17, wherein the central portion extends along a longitudinal axis, the first leg, the second leg, the third leg and the fourth leg extending parallel to the longitudinal axis.

19. The method of claim 13, wherein all steps of the method are completed without addition of heat.

20. The method of claim 13, wherein the bar pin is symmetrical about a plane passing through a longitudinal axis of the bar pin and an axis transverse to the longitudinal axis.

* * * * *